US006905017B1

(12) United States Patent
Sarnoff et al.

(10) Patent No.: US 6,905,017 B1
(45) Date of Patent: Jun. 14, 2005

(54) MUFFIN PAN AND MUFFIN LINER HOLDER

(75) Inventors: Norton Sarnoff, Northbrook, IL (US); Carl Fletcher, Kildeer, IL (US); Richard McCormick, Vernon Hills, IL (US)

(73) Assignee: Handi-Foil, Corp., Wheeling, IL (US)

( * ) Notice: Subject to any disclaimer, the term of this patent is extended or adjusted under 35 U.S.C. 154(b) by 0 days.

(21) Appl. No.: 10/803,326

(22) Filed: Mar. 18, 2004

(51) Int. Cl.[7] ..... B65D 69/00; B65D 77/00; B65D 21/00; B65D 75/00

(52) U.S. Cl. ..... 206/223; 206/216; 206/499; 206/518; 206/806

(58) Field of Search ..... 206/216, 461, 206/471, 467, 493, 499, 223, 541, 516, 518, 206/519, 564, 806, 526; 220/212, 23.87, 220/23.91

(56) References Cited

U.S. PATENT DOCUMENTS 3,379,536 A 4/1968 Foss et al.
4,444,310 A * 4/1984 Odell ..... 206/366
5,220,999 A 6/1993 Goulette
6,003,671 A * 12/1999 McDonough et al. ..... 206/493
6,146,673 A * 11/2000 Ferguson ..... 426/115
6,279,736 B1 * 8/2001 Hekal ..... 206/204
2002/0108880 A1 * 8/2002 Krupa et al. ..... 206/497
2004/0011698 A1 * 1/2004 Gaffney et al. ..... 206/704

* cited by examiner

*Primary Examiner*—Mickey Yu
*Assistant Examiner*—Faye Francis
(74) *Attorney, Agent, or Firm*—Adam K. Sacharoff; Much Shelist

(57) ABSTRACT

A tray and method for packaging muffin pans and liners. The tray surrounds the outer bottom and side surfaces of the packaged muffin pans and muffin liners, protecting the same from damage. The tray includes an engagement portion with a lower surface and a lip, whereby rims defined by the packaged muffin pans are securely held therebetween. An integral hang tab extends outwardly from the packaging tray to enable the tray with packaged muffin pans and liners to be hung from a display rack. The muffin pans are snap-locked into the tray by pressing the rims against the lip, which flexes allowing the muffin pans to pass by and then snaps back to retain the muffin pans and muffin liners within the tray.

7 Claims, 6 Drawing Sheets

MUFFIN PAN AND MUFFIN LINER HOLDER

FIELD OF THE INVENTION

The present invention relates to the art of packaging foil pans and similar items. More particularly, the present invention is directed to a tray for packaging muffin pans and muffin liners to form a packaged assembly.

BACKGROUND OF THE INVENTION

Foil pans are typically displayed in stores and sold to consumers as part of a packaged assembly. Such foil pans may be round, square, or oval and are made out of aluminum foil typically having a thickness of from about 30 to 45 gauge. The packaged assembly generally includes a plurality of foil pans, nested together, and packaging to hold the foil pans together. Labels are also often provided, placed either on the packaging or on the foil pans themselves. The packaged assembly may be displayed in the store resting on a shelf in a horizontal orientation. However, the packaging may also include means for hanging the packaged assembly so that it may be displayed in a vertical orientation, such as hanging from a display rack.

A number of such packaging structures and methods are known. In one approach, a band made out of a heat-shrinkable plastic is placed around the outwardly-extending flange portions of the nested foil pans. Upon the application of heat, the plastic shrinks so as to fit snugly about the top and bottom of the flanges, thereby holding the foil pans together. A disadvantage of this method is that, because of their thin gauge nature, foil pans are easily dented, scratched, bent, crushed, or otherwise damaged during the handling that occurs before sale to the consumer. Particularly vulnerable is the outer surface of the assembly of nested foil pans, namely, the bottommost foil pan, which is susceptible to surface marring during shipment or display. Because the plastic band only covers the flange portions of the foil pans, the bottom and sides of the bottom foil pan in the packaged assembly remain exposed and are therefore subject to such damage. Another disadvantage of this method is that the heat shrink plastic band does not provide a good way to attach a hang tab to allow the foil pans to be hung for display.

Another approach is to use "blister" packaging, which typically consists of a top half and a bottom half, both halves being made out of a clear plastic. The nested foil pans are held between the two halves, which are then joined by heat-sealing, taping, stapling, or similar methods. Because the packaging completely surrounds the foil pans, the foil pans are protected to some degree from damage. A hang tab may also be conveniently provided on the "blister" packaging. However, "blister" packaging has the disadvantage of requiring more material and a complex packaging process in that the two halves must be mated together. Another disadvantage is that, because the packaging completely surrounds the foil pans, the consumer is not able to touch and feel any portion of the surface of the foil pans. Such direct and tactile observation of the foil pans is important in bolstering consumer confidence with the product and thus serves to enhance marketability.

Goulette U.S. Pat. No. 5,220,999 discloses a nestable container comprising a base and a hinged lid that may be used to package articles such as foil pans. The container is closed by means of a tongue disposed on the lid which engages a mating projection disposed on the base. A hang tab is also provided on the lid. When the lid is closed, the container completely surrounds the packaged articles. Preferably, the container is made out of a clear plastic so that the consumer is able to see the packaged articles. However, the consumer is unable to touch the packaged articles without opening the container. This presents a significant inconvenience to the consumer, particularly if the container is hung from a display rack. Indeed, if the container is opened while it is hung, either intentionally or by accident, the articles can easily fall out. Another disadvantage of this container is the complexity of its design.

Foss, et al. U.S. Pat. No. 3,379,536 discloses a pie crust package. A plurality of nested pie crust filled pie pans are held together in assembled relation by means of a clear plastic member dish-shaped to conform to the shape of the uppermost pie pan. The plastic member covers the top of the uppermost pie pan and has a downwardly depending flange with circular grooves to engage the peripheral edges of the pie pans. In this way, each packaged pie pan is held in a circular groove. A disadvantage of this design when used with foil pans is that, although the top most foil pan would be covered, the more vulnerable bottommost foil pan would remain exposed and thus subject to damage. Another disadvantage is that no hang tab is provided in the Foss assembly, so that no means are provided for display in a vertical orientation. The lack of a hang tab further means that no fixed reference point is provided to ensure that a label affixed to a Foss assembly displayed for retail will be in the proper orientation for reading or even that the labels on nested assemblies will all be in the same orientation.

SUMMARY OF THE INVENTION

In accordance with the present invention a packaged assembly is defined and includes a predetermined plurality of stacked and nested muffin pans having a bottommost and an uppermost pan. Each muffin pan is substantially identical to the others and each muffin pan has a plurality of baking wells that extend downwardly at a predetermined angle to define a baking well bottom, a baking well side. The muffin pan further has an outwardly-extending muffin pan top portion ending in a circumferential rim. A predetermined plurality of muffin liners is also included and each liner has a predetermined shape that is defined to fit within the baking wells of the muffin pans. The muffin liners are stacked and nested against an outside surface defined by the baking wells of the muffin pans to define a bottommost and an uppermost muffin liner, such that the uppermost muffin liner is positioned against the bottommost muffin pan.

The packaging tray within which the plurality of muffin pans and muffin liners are fully received, has a tray bottom portion substantially conforming in dimensions and shape to the muffin pan bottom including a plurality of wells sized to receive the baking wells of the bottommost muffin pan and the plurality of muffin liners, wherein the bottommost muffin liner is surrounded by an inner bottom and inner side surface defined by each well of the plurality of wells, and the bottommost muffin pan is surrounded by a top surface of the packaging tray. A tray engagement portion extends peripherally outwardly and upwardly from the tray top portion. The tray engagement portion has a lower region extending outwardly from the tray top portion and an upper region extending upwardly from the lower region. The upper region has an upper periphery, that has an attached lip whose width slightly overlies the rim defined by the uppermost one of said plurality of muffin pans and whose length extends circumferentially to overlie the entire circumferential muffin pan rim. Therefore, the plurality of muffin pans and muffin liners are releasably snap locked in the packaging tray between the lower region and the inward protrusion of the engagement portion.

Numerous other advantages and features of the invention will become readily apparent from the following detailed description of the invention and the embodiments thereof, from the claims, and from the accompanying drawings.

BRIEF DESCRIPTION OF THE DRAWINGS

A fuller understanding of the foregoing may be had by reference to the accompanying drawings, wherein.

DETAILED DESCRIPTION OF THE EMBODIMENTS

Figure 1:
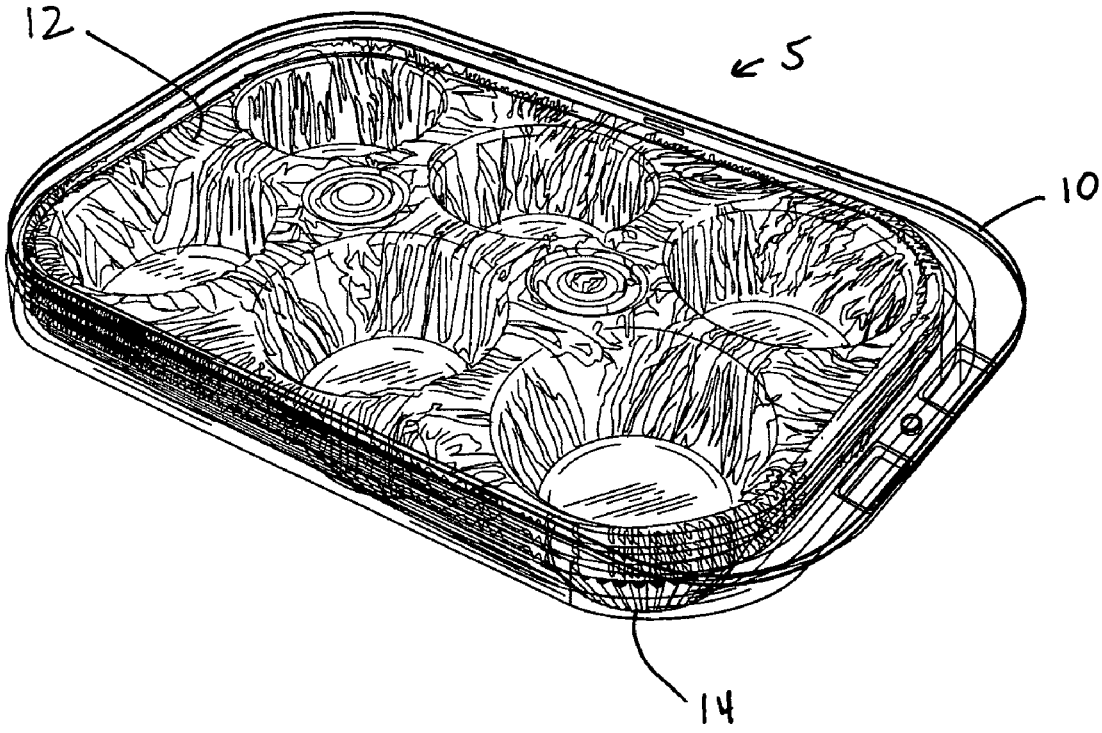
FIG. 1 is a perspective view of the packaging tray illustrated with stacked muffin pans and muffin liners.

While the invention is susceptible to embodiments in many different forms, there are shown in the drawings and will be described herein, in detail, the preferred embodiments of the present invention. It should be understood, however, that the present disclosure is to be considered an exemplification of the principles of the invention and is not intended to limit the spirit or scope of the invention and/or claims of the embodiments illustrated.

Figure 2:
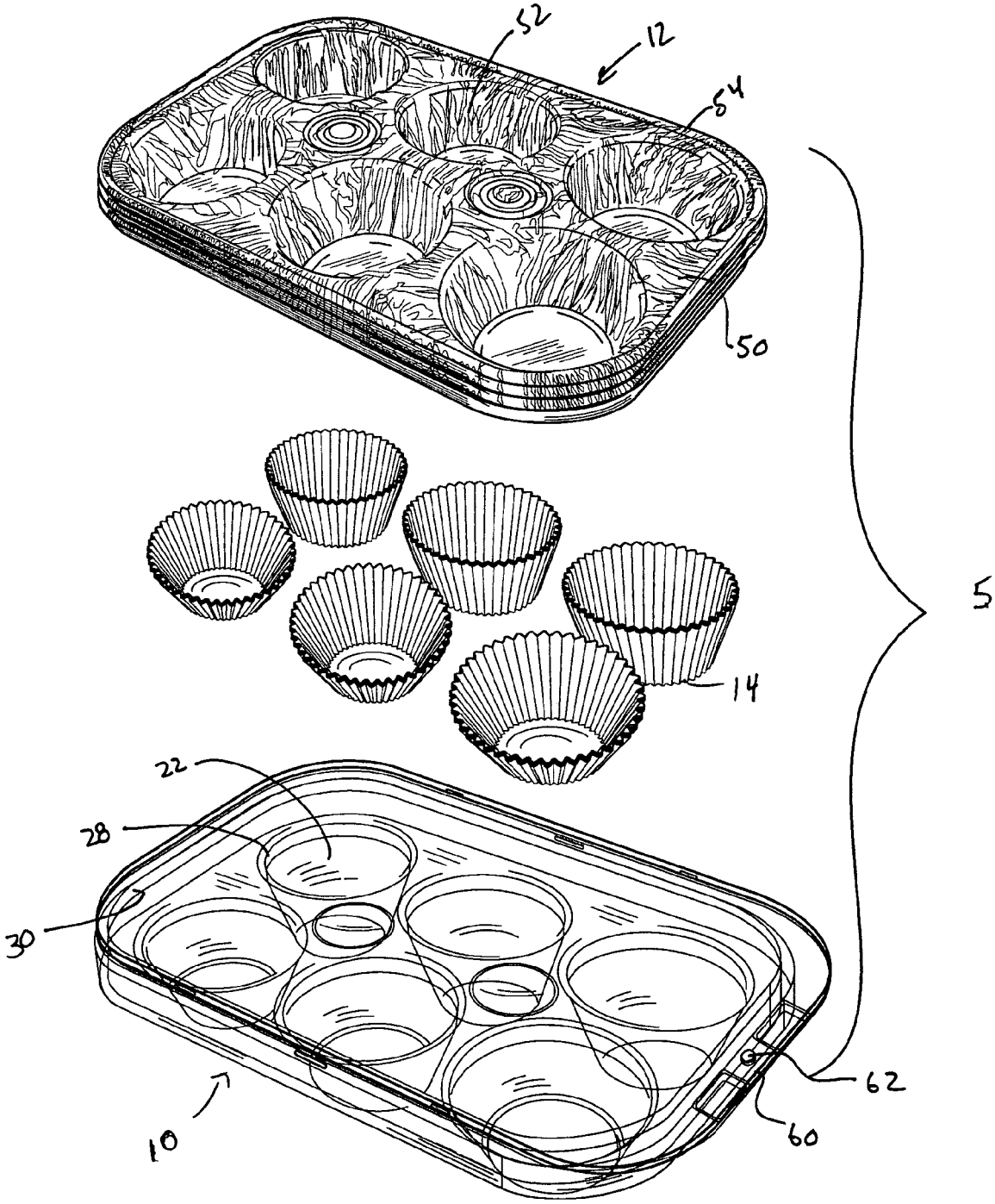
FIG. 2 is a perspective exploded view of FIG. 1.

With reference to FIGS. 1 and 2, a preferred embodiment of a tray 10 for packaging foil muffin pans 12 and paper muffin liners 14 is shown. The tray 10 is preferably made out of a thin gauge transparent and resilient plastic. Most preferably, the tray 10 is made out of biaxially oriented polystyrene (referred herein as OPS) having a thickness in the range of about 6 mils to about 10 mils.

Figure 3:
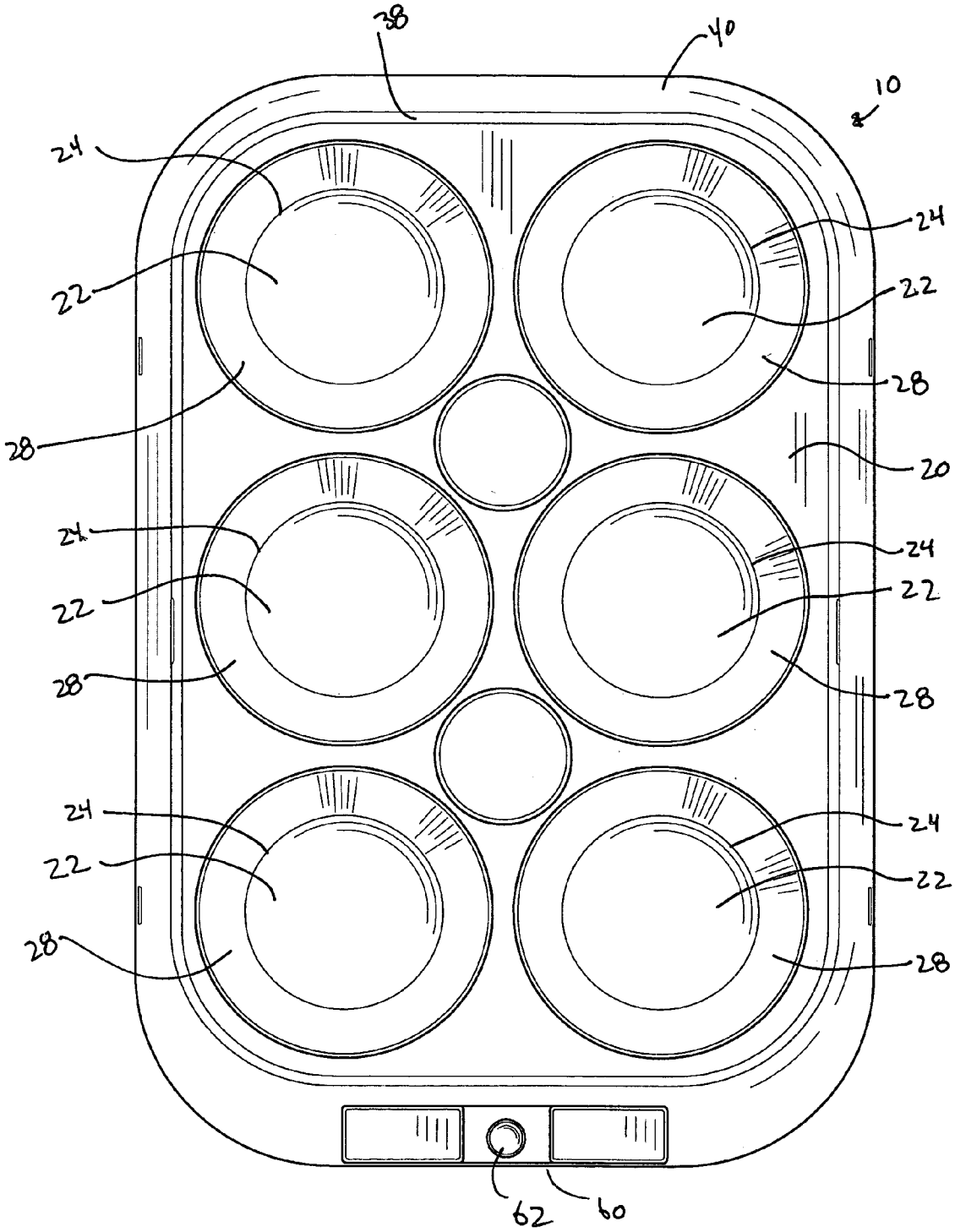
FIG. 3 is a top view of the packaging tray from FIG. 1.
Figure 4:
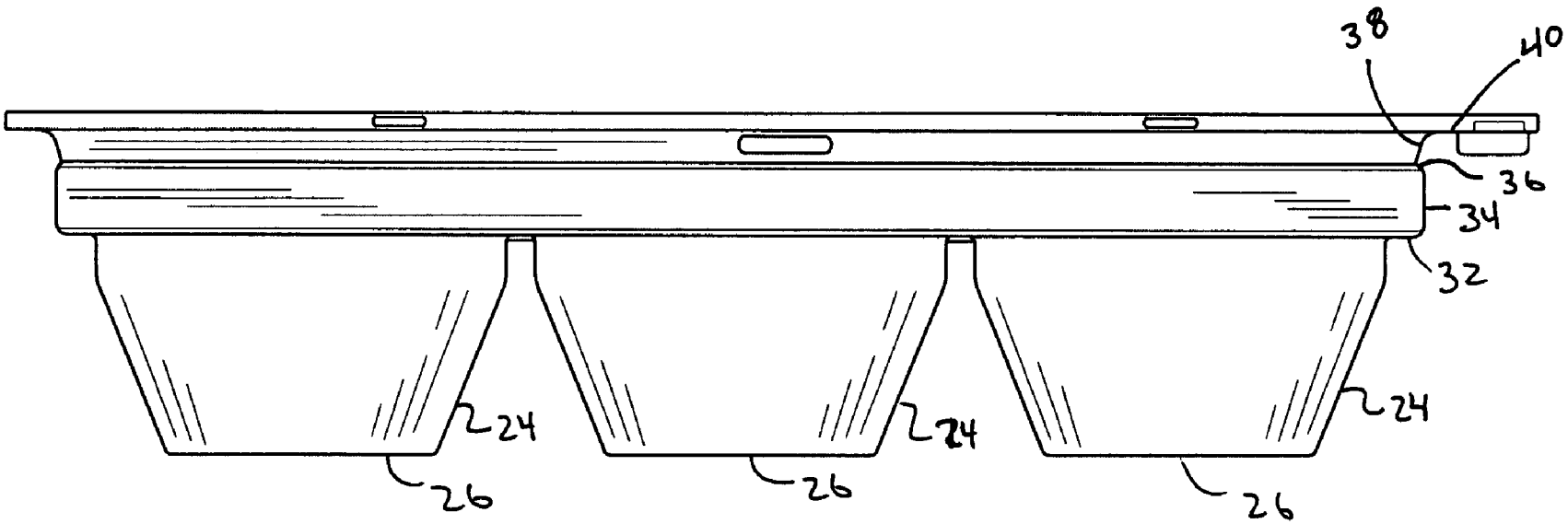
FIG. 4 is a side view of the packaging tray from FIG. 1.

The tray 10, as shown in FIGS. 3 and 4, has a generally planer top portion 20 from which a plurality of wells 22 protrude downwardly. Each well 22 includes a side wall 24 extending downwardly with the larger end open upwardly. The side wall 24 blends into a closed end that is generally a circular bottom portion 26 that closes the bottom of the baking well 22. The top edge of each well 22 is completely surrounded by a vertically extending ridge 28 that may be generally planar with the top portion 20 of the tray 10. The top portion 20 is connected to an engagement portion 30.

Figure 5:
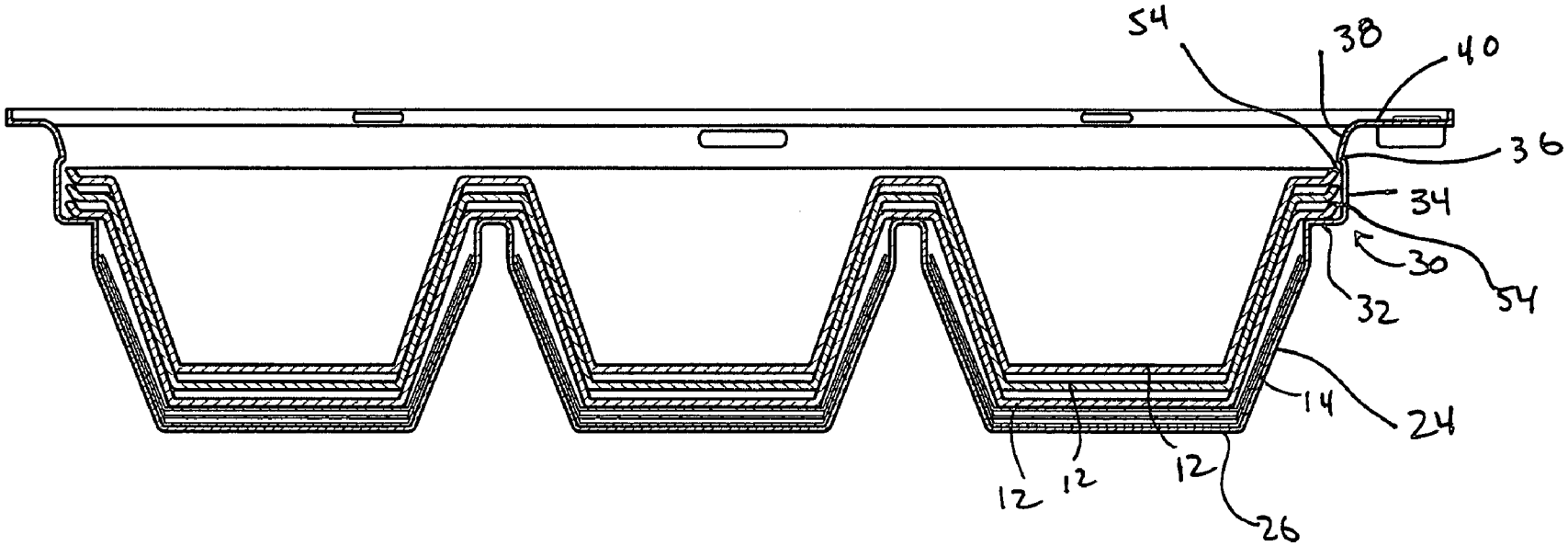
FIG. 5 is a cross sectional view of the packaging tray of FIG. 1, illustrated through the wells of the tray.

With reference to FIG. 5, the engagement portion 30 includes a lower surface 32 that extends outwardly from the top portion 20. Extending upwardly from lower surface 32 is a vertical wall 34, which turns inwardly and upwardly to form a lip 36. This configuration defines the engagement portion 30. Extending from the engagement portion 30, the tray 10 curves outwardly to form a transition surface 38 to an outer surface 40.

Continuing to refer to FIGS. 2 and 5, the tray 10 is shown in a cross sectional side view with three foil muffin pans 12 and three sets of paper muffin liners 14 (each set consists of six liners, one liner for each baking well). The muffin pans 12 and muffin liners 14 are nested together and packaged therein. Each foil muffin pan 12 has an top portion 50 that outwardly-extends from its baking wells 52 ending in a circumferential rim 54. The distance from the rim 54 on one side of the muffin pan 12 to rim on the opposite side of the muffin pan 12 defines the rim width of the muffin pan 12. Although three muffin pans 12 are shown, the tray may be shaped such that a greater or lesser number of muffin pans may be packaged by the tray 10. In addition, although three sets of muffin liners 14 are shown, the number of muffin liners 14 would be made to match the number of muffin pans and the number of baking wells. As it can be appreciated more or less baking wells can be used, without deviating from the scope and spirit of the present invention.

As shown and illustrated in FIG. 5, the bottom surface 26, the side wall 24, the lower surface 32, the vertical wall 34, and lip 36 surround the muffin pans 12 and the muffin liners 14 are positioned in the wells 22 under the baking wells 52 of the muffin pans 12. Thus, the muffin pans 12 and muffin liners 14 are captured by the tray 10. The muffin pans 12 are also shielded from scratching, denting, marring, or other such damage caused by impacts. Moreover, the rigidity of the tray 10 reduces the chances of the packaged foil pans 12 from becoming bent, twisted, or otherwise deformed during handling. However, because the tray 10 includes an open top, the inner surface of the topmost foil pan 12 may be observed and touched by the consumer. In addition, all of the muffin liners 14 are protected from tearing or damage.

As shown in the drawings, the vertical wall 34 of the engagement portion 30 is sized to correspond to the height of the stacked rims 54 of the muffin trays 12.

Moreover, the side walls 24 of the wells 22 taper outwardly at an angle that is greater than the angle of the outside portion of the baking well 52 of the muffin pans 12 to provide additional space to accept the muffin liners 14. This is an important feature of the present invention as similar trays in the past did not have to accommodate for the extra thickness of the muffin liners 14. The extra space is needed such that the liners are not damaged or crushed when the muffin pans 12 are placed in the tray 10.

With the tray 10 formed from OPS or similar material, engagement of the muffin pans 12 and paper muffin liners 14 is accomplished because the tray 10 has sufficient flexibility to allow the outwardly extending top portions of the foil muffin pans 12 to be snap-locked into place under the lip of the tray.

As shown throughout the FIGS the tray 10 is preferably made with an integral hang tab 60. The hang tab 60 is shaped to allow tray 10 with muffin pans 12 and muffin liners 14 packaged within to be hung from display rack in a vertical orientation. The hang tab 60 preferably includes a hole 62 able to receive a hook, bar, or the like disposed on a display rack. The hang tab 60 may also be hook-shaped to engage such a hook or bar on a display rack. The hang tab 60 may be formed into other shapes to accommodate the particular display requirements. Since the hang tab 60 is integral to the tray 10 and the packaged muffin pans 12 and muffin liners 14 are held firmly within tray 10, the locations of the hang tab 60 and hole 62 typically maintain a fixed relationship with respect to the tray 10 and packaged muffin pans 12 and liners 14. The registry of the hang tab 60 with respect to the rest of the tray 10 and the packaged muffin pans 12 and muffin liners 14 ensures that when a plurality of packaged assemblies 5 are nested together, the holes 62 can all be aligned so that the nested packaged assemblies 5 may all be hung together from the same hook, bar, or the like for display in a vertical orientation.

Typically, a label (not shown) is affixed to the uppermost one of the packaged muffin pans 12 and muffin liners 14 of packaged assembly 5, as shown in FIG. 1, for display to consumers. The fixed location of a hang tab 60 with respect to the packaged foil pans 30 provides a reference point for the proper orientation of a label.

Figure 6:
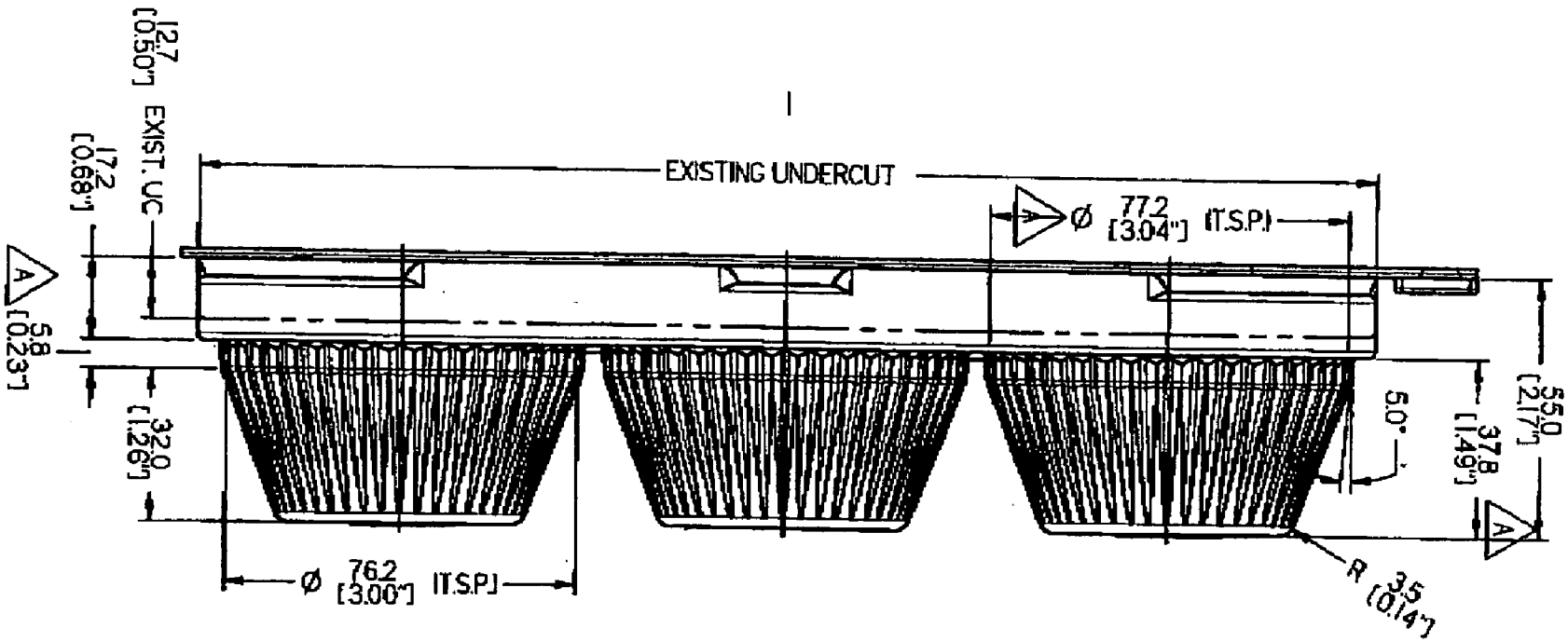
FIG. 6 is a side view of an alternative embodiment illustrating a packaging tray with ribs defined in the wells.

FIG. 6, shows an alternate embodiment of tray 10 wherein the wells 22 and side walls 24 include a plurality of tapered V-Flute ribs 70. The ribs 70 add strength to the bottom portion 26 and side walls 24 and receive muffin liners that are also ribbed without damaging or flatening the liners. By increasing the distance between the muffin liners 14 and the outer surface of tray 10, the ribs 70 also enhance the ability of the tray 10 to cushion the packaged muffin pans 12 and muffin liners 14 from impacts. In this way, the ribs 70 further protect the muffin liners 14 from un-creasing and damage.

From the foregoing and as mentioned above, it will be observed that numerous variations and modifications may be effected without departing from the spirit and scope of the novel concept of the invention. It is to be understood that no limitation with respect to the specific methods and apparatus illustrated herein is intended or should be inferred. It is, of course, intended to cover by the appended claims all such modifications as fall within the scope of the claims.

We claim:

1. A packaged assembly, comprising:

a predetermined plurality of stacked and nested muffin pans having a bottommost and an uppermost pan, each said muffin pan being substantially identical to the others thereof and each said muffin pan having a plurality of baking wells that extend downwardly at a predetermined angle to define a baking well bottom, a baking well side, and each of said muffin pan having an outwardly-extending muffin pan top portion ending in a circumferential muffin pan rim;

a predetermined plurality of muffin liners having a predetermined shape that is defined to fit within said baking wells of said muffin pans, said muffin liners stacked and nested against an outside surface defined by said baking wells of said muffin pans having a bottommost and an uppermost muffin liners nested against said bottommost muffin pan, wherein said uppermost muffin liner is positioned against said bottommost muffin pan;

a packaging tray within which said plurality of muffin pans and muffin liners are fully received, said packaging tray having:

a tray top portion substantially conforming in dimensions and shape to said muffin pan bottom including a plurality of wells sized to receive the baking wells of the bottommost muffin pan and the plurality of muffin liners, wherein said bottommost muffin liner being surrounded by an inner bottom and inner side surface defined by each well of the plurality of wells, and said bottommost muffin pan being surrounded by a top surface of said packaging tray;

a tray engagement portion extending peripherally outwardly and upwardly from said tray top portion, said tray engagement portion having a lower region extending outwardly from said tray top portion and an upper region extending upwardly from said lower region, said upper region having an upper periphery, said upper periphery having an attached lip whose width slightly overlies said rim defined by said uppermost one of said plurality of muffin pans and whose length extends circumferentially to overlie the entire circumferential muffin pan rim, whereby said plurality of muffin pans and muffin liners are releasably snap locked in said packaging tray between said lower region and said lip of said engagement portion.

2. The packaged assembly of claim 1, further comprising a hang tab attached to said packaging tray.

3. The packaged assembly of claim 2, wherein said hang tab is integral to said packaging tray.

4. The packaged assembly of claim 3, wherein said packaging tray is made out of plastic.

5. The packaged assembly of claim 4, wherein said plastic is biaxially oriented polystyrene.

6. The packaged assembly of claim 1, wherein said packaging tray includes wells that have tapered v-flute ribs defined along the side surface of the wells.

7. The packaged assembly of claim 1, wherein the wells of the tray include side surfaces that taper outwardly at an angle that is larger than an angle defined by the baking well of the bottommost muffin pan, such that the wells include an inner region sized to accommodate the baking wells of the stacked muffin pans and the stacked muffin liners.

* * * * *